United States Patent [19]

Verberne et al.

[11] 4,439,283

[45] Mar. 27, 1984

[54] ZINC COBALT ALLOY PLATING

[75] Inventors: Wim J. C. Verberne; John S. Hadley, both of 's-Hertogenbosch, Netherlands

[73] Assignee: OMI International Corporation, Warren, Mich.

[21] Appl. No.: 461,358

[22] Filed: Jan. 27, 1983

[30] Foreign Application Priority Data

| | | | |
|---|---|---|---|
| Jan. 29, 1982 | [GB] | United Kingdom | 8202581 |
| Jan. 29, 1982 | [GB] | United Kingdom | 8202580 |
| Jun. 2, 1982 | [GB] | United Kingdom | 8216049 |
| Nov. 22, 1982 | [GB] | United Kingdom | 8233238 |

[51] Int. Cl.[3] ..... C25D 3/56; C25D 5/10; C25D 5/48

[52] U.S. Cl. ..... 204/38 R; 204/40; 204/43 Z

[58] Field of Search ..... 204/43 Z, 43 T, 123, 204/38 R, 40

[56] References Cited

U.S. PATENT DOCUMENTS

| | | | |
|---|---|---|---|
| 4,048,381 | 9/1977 | Adaniya et al. | 428/632 |
| 4,064,320 | 12/1977 | Adaniya et al. | 428/632 |
| 4,252,866 | 2/1981 | Matsudo et al. | 428/659 |
| 4,299,671 | 11/1981 | Tremmel et al. | 204/35 R |

FOREIGN PATENT DOCUMENTS

| | | | |
|---|---|---|---|
| 47-16042 | 5/1972 | Japan | 204/43 Z |
| 49-32410 | 8/1974 | Japan | 204/43 T |
| 50-2867 | 1/1975 | Japan | 204/43 Z |
| 2094349 | 9/1982 | United Kingdom | 204/43 T |
| 254294 | 3/1970 | U.S.S.R. | 204/43 Z |
| 399578 | 2/1974 | U.S.S.R. | 204/43 Z |
| 508565 | 5/1976 | U.S.S.R. | 204/43 Z |

*Primary Examiner*—G. L. Kaplan
*Attorney, Agent, or Firm*—Richard P. Mueller

[57] ABSTRACT

The present invention relates to an improved electroplating bath and process for producing semi-bright to bright zinc cobalt alloy electrodeposits on substrates, and particularly non-planar substrates, to provide enhanced resistance to salt spray corrosion. The invention further contemplates the application of a thin passivate coating directly on the zinc-cobalt electrodeposit, or alternatively, on a substantially pure zinc flash over plate of a thickness sufficient to enable the zinc flash to be converted to an adherent substantially continuous zinc passivate.

24 Claims, 1 Drawing Figure

ZINC COBALT ALLOY PLATING

Figure 1:
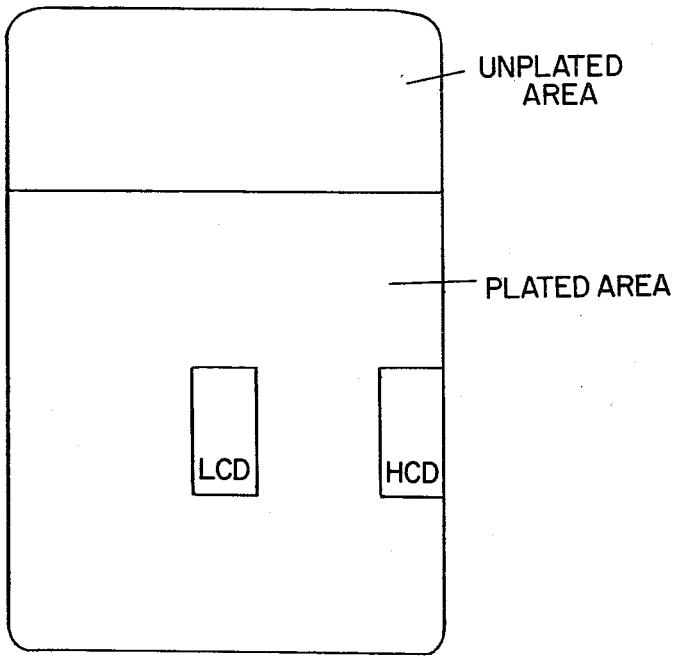

The present invention relates to composite zinc based electrodeposits of novel composition and to novel electroplating baths and processes useful for producing zinc cobalt alloy electrodeposits on non-planar substrates.

G.B. Application No. 2070063 (inventors—Adaniya et al) discloses the electrogalvanizing of continuous steel strip from a zinc, cobalt, chromium bath with high flow rates of electrolyte transverse to the movement of the cathodic strip between it and the anodes. The specification teaches that this combination will enable so-called bare corrosion resistance (prior to passivation) and corrosion resistance after passivation to be maintained at improved levels due to avoidance of large variations in cobalt content of the deposit when other factors in the process are varied within certain limits. Thus the cobalt content remains between 0.7 and 0.8% with variation in temperature from 35° to 60° C., (though at 30° C. it is about 1.1 and at 70° C. it is 3.2%).

At 50° C. the cobalt content only fluctuates between about 0.5 and 0.8% with variation in current density between 5 ASD and 40 ASD.

When the flow rate is 0.5 m/sec and the cobalt content in the bath varies from 5 to 35 g/l the cobalt content of the deposit varies from about 0.05 to about 0.9% whereas when the flow rate is only 0.1 m/sec the cobalt content of the deposit varies between about 0.5 and 5.2%.

At a cobalt content of 5 g/l and current densities of 30 to 40 ASD at a temperature of 50° C. the cobalt content of the deposit is about 0.2% at flow velocities of greater than 0.5 m/sec and at cobalt contents in the bath at 20 g/l the cobalt content is about 0.8% at flow velocities above 0.5 m/sec.

Adaniya teaches that deposits with cobalt in the presence of chromium with cobalt contents of at least 0.3% give improved bare corrosion resistance and that above 1.0% cobalt the deposit is blackened.

All Adaniya's teaching is on the basis of sulphate baths containing acetate and though he does mention that zinc chloride could be used all his examples are of sulphate baths. Moreover not only does Adaniya require the presence of chromium in the deposit but his examples are all concerned with cobalt deposits of 0.7% or 0.8% cobalt. Adaniya gives certain comparison or reference examples but these are pure zinc or have cobalt and chromium both present but with cobalt contents no higher than 0.08%.

Adaniya's test results on corrosion are referred to as being after chromating, no details of the chromating procedure being given.

Earlier work on this same process using the same bath type reported in Nippon Kokan Technical Report Overseas No. 26 (1979 p. 10–16 and Sheet Metal Industries International Dec. 1978 p. 73–79 and 82 refers to electrogalvanized steel strip which has been phosphated and which contains approximately 0.2% cobalt and approximately 0.05% chromium.

We are concerned with the problem of achieving improved corrosion resistance of non-continuous sheet components particularly such things as washers, screws, clips, and other components either of flat shape having cut outs or profiled edges, or recesses or non flat shapes or such things as housings e.g. windscreen wiper motor housings all of which through being not of continuous sheet form produce large variations in the current density conditions from place to place over their surfaces.

Thus they will have high current density (HCD) regions at their edges or at the ends of projections, low current density (LCD) regions in any cut outs, recesses or folds and will also have medium current density (MCD) regions.

We are concerned not only with producing improved corrosion resistance but also with achieving this while providing a finish of semi-bright or bright appearance; the better the appearance the more attractive the product is to the consumer provided corrosion resistance is maintained.

We have found that sulphate baths such as those of Adaniya are inadequate to provide bright or semi-bright continuous deposits on the components type products with which we are concerned.

In addition conventional zinc acid chloride baths with cobalt added to them were inadequate until we produced novel additive systems. Only then were we able to deposit zinc cobalt alloys at cobalt contents below 1% at which level such alloys become price competitive with zinc nickel alloys containing 10% nickel on which many people are working but as yet apparently without producing a commercially viable system. Such zinc nickel deposits also suffer from ductility problems being liable to be brittle.

Zinc cobalt alloys containing about 0.1% cobalt to about 1.5% cobalt deposited from sulphate baths containing acetate at pH 4.2 and 50° C. and 30 ASD on steel sheet have been reported by Adaniya in J. Electrochem. Soc. Vol. 128 No. 10 p. 2081–2085 (Oct. 1981). Chromating or passivation of these deposits is not disclosed.

We have tried to use this type of bath but again it is ineffective for recessed component type articles whose geometry enforces wide variations in current density from place to place on the surface being plated.

Spectroscopic analyses of zinc cobalt electroplates by Leidheiser et al has been reported in J. Electrochem Soc. Vol. 128 No. 7 p. 1456–1459 (July, 1981). Leidheiser again used a sulphate bath containing cobalt doped with 57 Co and very small amounts of chromium and also containing acetate.

Leidheiser reported deposits containing 0.68 to 0.90% cobalt; 0.12–0.24% cobalt; 0.08–0.12% cobalt; and 0.03–0.1% cobalt as well as 0.008 to 0.014%; approximately 0.5%, approximately 0.75% and approximately 2%. None of the deposits were referred to as being chromated or passivated.

We have discovered that zinc cobalt deposits on individual components which are not continuous sheet substrates can be formed by use of our novel acid chloride zinc cobalt plating bath and that the deposits can be semi-bright to bright over a wide current density range.

We have found that, at from about 0.10% particularly from 0.21 especially 0.25% cobalt up to 0.8% particularly less than 0.7% more particularly up to 0.67% especially up to 0.65% cobalt, much improved corrosion resistance prior to passivation is obtained and in addition that within this range of cobalt contents particularly in the range 0.1 to 0.4 especially 0.15 to 0.35% cobalt passivation can be achieved e.g. by conventional dichromate passivation to give improved overall corrosion resistance.

Thus according to the present invention there is provided a component affording a non-planar surface, the said surface carrying a continuous adherent semi-bright or bright zinc cobalt alloy electrodeposit containing up to about 5% by weight cobalt, usually less than about 1% cobalt, generally from 0.1% to 0.8% cobalt, preferably 0.1 to less than 0.7% cobalt, preferably 0.15 to 0.65% and especially 0.21 to 0.35% cobalt more particularly 0.22 to 0.30% cobalt, the deposit preferably being at least 1 micron e.g. at least 2 microns thick and especially 2 to 20 thick more preferably 3 to 15 e.g. 5 to 10 microns.

By planar we mean any surface which is flat and is free of apertures, cut outs, recesses or undulations. A non-planar surface is any surface which is not planar as defined above.

The cobalt content of a zinc cobalt deposit can readily be determined by dissolving the deposit in dilute hydrochloric acid and measuring the cobalt content by the conventional procedure of induced couple plasma atomic emission spectrophotometry (referred to herein as I.C.P. analysis).

Such deposits in accordance with the present invention have the advantage that they can also be passivated e.g. with conventional dichromate dip passivation solutions. According to an alternative satisfactory embodiment of the present invention there is provided an article comprising a substrate having a non-planar conductive external surface on which is deposited a bright zinc cobalt electrodeposit containing cobalt in an amount effective to provide enhanced resistance to salt spray corrosion as in ASTM 117 and a thin zinc flash of a thickness which is sufficient to enable it to be converted to an adherent substantially continuous zinc passivate.

We have found that particularly good results in terms of total corrosion resistance can be obtained when the cobalt content is in the range 0.1 to 0.4% by weight especially 0.15 to 0.35%.

The invention in a preferred form thus also extends to an article the surface of which carries a continuous adherent passivated zinc cobalt alloy electrodeposit containing from 0.1% to 0.4% by weight cobalt preferably 0.15 to 0.35%, the deposit preferably being at least 1 micron e.g. at least 2 microns thick and especially 2 to 20 more preferably 3 to 15 e.g. 5 to 10 microns thick, the said surface also preferably being semi-bright to bright.

The article in this aspect of the invention may be a component affording a non-planar surface or the article may be planar.

According to another aspect of the present invention there is provided an electroplating bath for producing bright zinc-cobalt electrodeposits desirably containing 0.1 to 0.8% and particularly 0.15% to 0.65% cobalt which comprises, as ingredient A, a source of zinc ions; as ingredient B, a source of cobalt ions; as ingredient C, a source of chloride ions (which may be the same as A or B or different); as ingredient D, boric acid; as ingredient E, benzoic acid, salicylic acid, or nicotinic acid or a bath compatible alkali metal or ammonium salt thereof; as ingredient F, benzylidene acetone, as ingredient G, N-allyl thiourea or a compound having the formula:

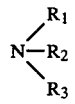

wherein:

$R^1$ represents an alkyl group having 1 to Y carbon atoms or an alkyl group having from 1 to Y carbon atoms at least one of which is substituted by a hydroxyl group; and $R^2$ or $R^3$ or both represent a hydrogen atom or an alkyl group of 1 to Y carbon atoms or an alkyl group of 1 to Y carbon atoms at least one of which is substituted by a hydroxyl group or an amino group and $R^2$ and $R^3$ may be the same or different and may be the same as or different to $R^1$, Y being an integer from 2 to 6 and preferably 2, 3 or 4, and preferably at least one of $R^1$, $R^2$ and $R^3$ is an alkyl group substituted by a hydroxyl group and as ingredient H, an ethoxylated long chain acetylenic alcohol or an ethoxylated alkylamine, or a polyethylene glycol, preferably having a grain refining effect, the bath containing at least one, preferably at least 2, especially at least 3 and most desirably all of ingredients, E, F, G and H, e.g. G and H or G and F or G and E, or G, H and F or G, H and E; or F and H, or E and F and H, the bath having a pH of 3 to 6 e.g. 4 to 5.

In broader terms ingredient H may comprise a polyether having a molecular weight ranging from about 100 up to about 1,000,000; a polyalkylene glycol such as a polyethylene glycol, or a polypropylene glycol; a polyglycidol; an ethoxylated phenol; an ethoxylated naphthol; an ethoxylated acetylenic glycol; an ethoxylated olefin glycol; an ethoxylated alkyl amine or a mixture thereof.

Ingredient G may be triethanolamine in which $R^1=R^2=R^3=-CH_2CH_2OH$ or N-allyl thiourea.

Ingredient G can be omitted for low current density plating such as barrel plating but is highly desirable when higher current density plating such as rack plating is being carried out.

Ingredient A is preferably provided by zinc chloride e.g. at a concentration of 40 to 120 g/l e.g. 60 to 100 and especially 70 to 90 g/l i.e. 33 to 43 g/l of zinc ions.

Ingredient B is preferably provided by cobalt sulphate or cobalt chloride e.g. with the sulphate e.g. at a concentration of 20 to 60 g/l e.g. 30 to 50 and especially 35 to 45 g/l (i.e. 7 to 10 g/l of cobalt ions.

Ingredient C is preferably provided by an alkali metal or ammonium chloride e.g. sodium chloride e.g. at a concentration of 85 to 245 g/l or 100 to 200 g/l and especially 150 to 180 g/l i.e. 90 to 100 g/l of chloride ions or when in the preferred case of ingredient A being zinc chloride in a range of 125 to 165 g/l of chloride ions (based on 70 to 90 g/l $ZnCl_2$ and 150 to 180 g/l of NaCl).

Potassium chloride can be used instead of sodium chloride and has the advantage of raising the cloud point of the anionic and nonionic wetting agents.

Ingredient D, boric acid, is optionally but preferably present at a concentration of 15 to 45 g/l e.g. 20 to 40 and especially 25 to 35 g/l.

Ingredient E may be sodium salicylate or sodium nicotinate or sodium benzoate and is preferably present at a concentration in the range 2 to 12 g/l e.g. 3 to 10 especially 4 to 6 g/l.

Ingredient F, benzylidene acetone is preferably present at a concentration of 0.05 to 0.5 g/l e.g. 0.07 to 0.2 g/l.

Ingredient G may be triethanolamine which may be used in an amount of 0.5 to 5 ml/l e.g. 0.7 to 3 ml/l but is preferably N-allyl thiourea which may be used in amount of 0.01 to 1 g/l e.g. 0.05 to 0.5 g/l.

Ingredient H, may be an ethoxylated long chain acetylenic alcohol, which is preferably a $C_6$ to $C_{15}$ e.g. $C_8$ to $C_{12}$, especially $C_{10}$ carbon chain compound which may be substituted with one or more e.g. 2 to 6 especially four side chains, e.g. up to 4 carbon atoms especially methyl, preferably the reaction product of 20 to 40 e.g. 25 to 35 especially 30 moles of ethylene oxide per mole of acetylenic alcohol, and in particular is preferably provided by an ethoxylated tetra methyl decyndiol, EO 30:1, which may be used at a concentration of 1 to 10 g/l e.g. 2 to 8 especially about 4 to 6 g/l; or may be an ethoxylated long chain alkyl amine, in which the alkyl group is preferably a $C_{10}$ to $C_{30}$ e.g. $C_{16}$ to $C_{20}$ especially a $C_{18}$ carbon chain group, preferably the reaction product of 10 to 100 e.g. 40 to 60 especially 50 moles of ethylene oxide per mole alkylamine, and in particular is preferably an ethoxylated ($C_{18}$ alkyl) amine, EO 50:1, which may be used at a concentration of 0.1 to 10 g/l e.g. 0.5 to 5 g/l especially 1 g/l; or may be a polyethylene glycol having a molecular weight in the range 1000–6000 especially 1250 to 4500 especially about 1500 to 4000, which may be used in an amount of 0.1 to 10 g/l e.g. 1 to 5 g/l especially 4 g/l.

In one preferred form of the invention there is provided an electroplating bath for producing bright zinc cobalt electrodeposits preferably containing 0.1 to 1.0% cobalt which comprises as ingredient A, as a source of zinc ions, zinc chloride ($ZnCl_2$) at a concentration of 40 to 120 g/l e.g. 60 to 100 and especially 70 to 90 g/l; as ingredient B, as a source of cobalt ions, cobalt sulphate ($CoSO_4.7H_2O$) at a concentration of 20 to 60 g/l e.g. 30 to 50 and especially 35 to 45 g/l; as ingredient C, as a source of chloride ions, sodium chloride at a concentration of 85 to 245 g/l e.g. 100 to 200 g/l and especially 150 to 180 g/l; as ingredient D, boric acid, at a concentration of 15 to 45 g/l e.g. 20 to 40 and especially 25 to 35 g/l; as ingredient E, sodium benzoate at a concentration in the range 2 to 12 g/l e.g. 3 to 10 especially 4 to 6 g/l; as ingredient F, benzylidene acetone, at a concentration of 0.05 to 0.5 g/l e.g. 0.07 to 0.2 g/l; as ingredient G, triethanolamine in an amount of 0.5 to 5 ml/l e.g. 0.7 to 3 ml/l; as ingredient H, ethoxylated tetra methyl decyndiol—EO 25–35:1, in an amount of 1 to 10 g/l and especially 4 to 6 g/l, the bath having a pH of 3 to 6 e.g. 4 to 5.

In another preferred form of the invention there is provided an electroplating bath for producing bright zinc-cobalt electrodeposits preferably containing in excess of 0.21% cobalt which comprises as ingredient A, as a source of zinc ions, zinc chloride ($ZnCl_2$) at a concentration of 40 to 120 g/l e.g. 60 to 100 and especially 70 to 90 g/l; as ingredient B, as a source of cobalt ions, cobalt chloride ($CoCl_2.7H_2O$) at a concentration of 20 to 60 g/l e.g. 25 to 45 and especially 30 to 40 g/l; as ingredient C, as a source of chloride ions, potassium chloride at a concentration of 85 to 245 g/l or 100 to 200 g/l and especially 150 to 180 g/l; as ingredient D, boric acid, at a concentration of 15 to 45 g/l e.g. 20 to 40 and especially 25 to 35 g/l; as ingredient E, sodium benzoate at a concentration in the range 1 to 12 g/l e.g. 2 to 8 especially 2 to 4 g/l; as ingredient F, benzylidine acetone, at a concentration of 0.05 to 0.5 g/l e.g. 0.07 to 0.2 g/l; as optional ingredient G, N-allyl thiourea in an amount of 0.1 to 1 g/l e.g. 0.05 to 0.5 g/l; as ingredient H, ethoxylated tetra methyl decyndiol—EO 25–35:1, in an amount of 1 to 10 g/l and especially 4 to 6 g/l, or an ethoxylated ($C_{16-20}$ alkyl)amine EO 40–60:1 in an amont of 0.1 to 10 g/l e.g. 0.5 to 5 g/l or a polyethylene glycol of M.W. 2500–4500 in an amount of 0.1 to 10 g/l e.g. 1 to 5 g/l or a mixture thereof, the bath having a pH of 3 to 6 e.g. 4 to 5.

The electroplating bath in accordance with this aspect of the invention is preferably used at a pH of 4 to 5 at a temperature of 15° to 30° C. and a current density of 1 to 5 amps per square decimeter (ASD). It is preferably used with mechanical agitation. The substrate to be plated is used as the work piece and pure zinc anodes are used.

A zinc passivate may be provided by chromate or dichromate passivation for example using an immersion passivation bath.

The component or substrate so coated can then be used without further treatment (apart from washing and drying) having an excellent bright or semi-bright appearance or it may be given an organic coating e.g. of lacquer, wax or paint.

As mentioned above the zinc cobalt electrodeposit is preferably provided with an adherent passivate e.g. by conventional passivation. The preferred passivation is a dichromate passivation as this provides very effective corrosion resistance. Other passivation techniques are however contemplated as being encompassed within the scope of the invention.

The invention also extends to a multistage process in which the zinc cobalt electrodeposit has a substantially pure zinc flash electrodeposited on it and this zinc flash is then converted to a zinc passivate.

The zinc flash is preferably substantially pure zinc e.g. 99.90% or 99.95% or higher zinc and is preferably substantially free of cobalt and certainly contains less than, e.g. less than 10% e.g. less than 5% or more preferably less 1% of, the amount of in the zinc cobalt layer. The zinc flash is of a thickness such as to leave the bright appearance of the zinc cobalt layer still apparent so that the appearance of the composite is bright as well though it may not be quite as bright as the zinc cobalt layer before the application of the zinc flash. Typically the zinc flash is less than 1 micron thick e.g. less than 0.7 microns or even less than 0.5 microns thick. The lower limit of thickness is dictated by the required function that it be thick enough to afford an adherent zinc passivate on passivation. The preferred passivation is a dichromate passivation especially an immersion dichromate passivation as this provides very effective corrosion resistance. Other passivation techniques are however contemplated as being encompassed within the scope of the invention.

The passivation dissolves most of the pure zinc flash forming a zinc passivate in place thereof. The thickness of the passivate may be greater than the thickness of the original zinc flash.

The zinc flash may be produced by brief electrolytic contact e.g. for 5 to 40 e.g. 20 to 30 seconds in a pure zinc electroplating bath e.g. containing 40 to 120 g/l e.g. 60 to 100 and especially 70 to 90 g/l of zinc chloride, 85 l to 245 g/l e.g. 100 to 200 g/l and especially 150 to 180 g/l of sodium chloride and 15 to 45 e.g. 20 to 40 and especially 25 to 35 g/l of boric acid using the same plating conditions as for the zinc cobalt electroplating bath.

The zinc flash is then converted to a zinc passivate preferably by chromate or dichromate passivation for example using an immersion passivation bath at 22° C. for a time insufficient to dissolve all of the zinc flash e.g. 20 to 30 seconds.

The component or substrate so coated can then be used without further treatment (apart from washing and drying) having an excellent bright appearance or it may be given an organic coating e.g. of lacquer, wax or paint.

The invention can thus be seen as affording the possibility of providing protective composite plating structures on non-planar substrates, e.g. having substantial variations in current density from high to low current density regions, e.g. from 0.1 to 8 or 9 ASD.

The invention may be put into practice in various ways and certain specific embodiments will be described to illustrate the invention with reference to the following examples. All parts and percentages herein are by weight unless otherwise specified.

EXAMPLE 1

Preparation of a zinc cobalt electrodeposit

A bath having the following composition was made up:

| | |
|---|---|
| Ingredient A | |
| Zinc chloride ($ZnCl_2$) | 80 g/l |
| | 40 g/l zinc |
| Ingredient B | |
| Cobalt sulphate ($CoSo_4.7H_2O$) | 38.4 g/l |
| | 8 g/l cobalt |
| Ingredient C | |
| Sodium chloride | 165 g/l |
| | 100 g/l chloride ion |
| Total chloride ion | 142 g/l |
| Ingredient D | |
| Boric acid | 30 g/l |
| Ingredient E | |
| Sodium benzoate | 4.75 g/l |
| Ingredient F | |
| Benzylidene acetone ($C_6H_5CH{=}CHC{=}OCH_3$) | 0.1 g/l |
| Ingredient G | |
| Triethanolamine | 1 ml/l |
| Ingredient H | |
| 2, 3, 7, 9, Tetramethyl 5 decyn 4, 7 diol ethoxy lated EO 30:1. | 4.8 g/l |
| pH | 4.5 |

A flat mild steel panel was cleaned and activated conventionally using normal procedures for zinc plating steel and then given a 10 micron coating by immersion in the above bath at 23° C. for 10 minutes at a current density of 2 ASD using mechanical agitation. The deposit was bright contained 0.6 to 0.8% cobalt and had excellent corrosion resistance when tested by the neutral salt spray method of ASTM 117.

EXAMPLE 2

Preparation of a zinc cobalt electrodeposit

A bath having the following composition was made up:

| | |
|---|---|
| Ingredient A | |
| Zinc chloride ($ZnCl_2$) | 80 g/l |
| Ingredient B | |
| Cobalt chloride ($CoCl_2.6H_2O$) | 32.5 g/l |
| Ingredient C | |
| potassium chloride | 165 g/l |
| | 78.6 g/l chloride ion |
| Total chloride ion | 128 g/l |
| Ingredient D | |
| Boric acid | 30 g/l |
| Ingredient E | |
| Sodium benzoate | 3.0 g/l |

-continued

| | |
|---|---|
| Ingredient F | |
| Benzylidene acetone ($C_6H_5CH{=}CHC{=}OCH_3$) | 0.1 g/l |
| Ingredient G | |
| N—allyl thiourea | 0.1 g/l |
| Ingredient H | |
| 2, 3, 7, 9, Tetramethyl 5 decyn 4,7 diol ethoxy-lated EO 30:1 | 1.0 g/l |
| ethoxylated ($C_{18}$alkyl)amine EO 50:1 | 1 g/l |
| polyethylene glycol M.W. 4000 | 4 g/l |
| pH | 4.5 |

A flat mild steel panel was cleaned and activated conventionally using normal procedures for zinc plating steel and then given a 10 micron coating by immersion in the above bath at 23° C. for 10 minutes at a current density of 2 ASD using mechanical agitation. The deposit was bright contained 0.2 to 0.4% cobalt and had excellent corrosion resistance when tested by the neutral salt spray method of ASTM 117.

EXAMPLE 3

Preparation of a zinc cobalt electrodeposit

A bath having the following composition was made up:

| | |
|---|---|
| Ingredient A | |
| Zinc chloride ($ZnCl_2$) | 80 g/l |
| Ingredient B | |
| Cobalt chloride ($CoCl_2.6H_2O$) | 32.5 g/l |
| Ingredient C | |
| potassium chloride | 165 g/l |
| | 78.6 g/l chloride ion |
| Total chloride ion | 128 g/l |
| Ingredient D | |
| Boric acid | 30 g/l |
| Ingredient E | |
| Sodium benzoate | 3.0 g/l |
| Ingredient F | |
| Benzylidene acetone ($C_6H_5CH{=}CHC{=}OCH_3$) | 0.1 g/l |
| Ingredient G | Absent |
| Ingredient H | |
| 2, 3, 7, 9, Tetramethyl 5 decyn 4,7 diol ethoxy-lated EO 30:1 | 1.0 g/l |
| ethoxylated ($C_{18}$alkyl)amine EO 50:1 | 1 g/l |
| polyethylene glycol M.W. 4000 | 4 g/l |
| pH | 4.5 |

This bath was found to be satisfactory for low current density plating such as barrel plating, ingredient G only being necessary for high current density plating. Thus steel screws were barrel plated in the above bath at 27° to 29° C. for 15 to 20 minutes at an average current density of 0.5 to 1.0 ASD (e.g. a current of 100 Amps for a load having a surface area of 100 square decimeters) with a barrel rotation speed of about 6 R.P.M. The deposit was about 10 microns thick, was bright and contained 0.2 to 0.4% cobalt and had excellent corrosion resistance when tested by the neutral salt spray method of ASTM 117.

EXAMPLE 4

Production of a passivate

A conventional yellow dichromate passivation bath was used, which contained 4 g/l chromic acid, 1 g/l sodium sulphate, 3–4 ml/l of conc. nitric acid and had a pH of 1.4 to 1.8. It was used at 25° C. for 20–30 seconds immersion time.

The product of Example 1 was given a cold water rinse and immersed in the passivation bath at 22° C. for 35 seconds to form a passivate.

The passivated electroplate after rinsing in cold water and then hot water and drying still had a good bright appearance.

EXAMPLE 5

A pure zinc electrodeposit on the same test panel as used in Example 1 was prepared using a conventional plating bath consisting of:

Zinc sulphate ($ZnSO_4.7H_2O$): 500 g/l
Sodium sulphate ($Na_2SO_4.7H_2O$): 50 g/l
Sodium acetate: 12 g/l
pH: 4.0
at a current density of 15 ASD, a bath temperature of 50° C. and using a plating time of two minutes.

EXAMPLE 6

The product of Example 5 was given a cold water rinse and then passivated as in Example 4 for 20 seconds.

The products of Examples 1, 4, 5 and 6 were subjected to neutral salt spray testing according to ASTM 117 and the results are given in Table 1 below.

Other buffers instead of boric acid could be used as ingredient D but boric acid is preferred. The presence of ingredient D is preferred but may not be necessary in all cases.

TABLE 1

| Example | Weight of electro-deposit g/dm² | Deposit Composition % Co | Passivation | Beginning of white rust(2) (1) | 100% white rust(1) | Beginning of red rust(3) (1) | 30% red rust(1) |
|---|---|---|---|---|---|---|---|
| 1 | 0.67 | 0.6 | — | 24 | 24 | 240 | 406 |
| 4 | 0.67 | 0.6 | Dichromate 35 seconds | 240 | 480 | 576 | >648 |
| 5 | 0.64 | Zero | — | 24 | 24 | 72 | 120 |
| 6 | 0.64 | Zero | Dichromate 20 seconds | 168 | 384 | 480 | 648 |

Notes on Table 1:
(1)hours of exposure to neutral salt spray as in ASTM 117.
(2)white rust is zinc carbonates
(3)red rust indicates corrosion of the underlying steel substrate.

EXAMPLES 7 TO 23

Steel Hull cell panels (plated area 1 dm²) were plated in a 30 liter rectangular tank using bagged zinc anodes, filtration and a current density of 2 ASD, with air agitation from the bottom of the tank.

The plating solution used had varying cobalt contents within the range given below the precise value for each example being given in Table 2 below.

| Solution Composition | |
|---|---|
| Ingredient A | |
| $ZnCl_2$ | 78.0 g/l |
| Ingredient B | |
| $CoCl_2$ | 3.25–32.5 g/l (0.8 to 8.0 g/l as Co) |

-continued

| Solution Composition | |
|---|---|
| Ingredient C | |
| Potassium chloride | 165 g/l |
| Ingredient D | |
| Boric acid | 30 g/l |
| Ingredient E | |
| Sodium benzoate | 4 g/l |
| Ingredient F | |
| Benzylidene acetone | 0.05 g/l |
| Alkyl napthalene sulphonate | 0.2 g/l |
| Diethylene glycol mono ethyl ether | 0.2 g/l |
| Ingredient H | |
| 2, 3, 7, 9 tetramethyl 5 decyn 4, 7 diol ethoxylated EO 30:1 | 1.2 g/l |
| ethoxylated ($C_{18}$alkyl) amine EO 50:1 | 1.2 g/l |
| polyethylene glycol MW 4000 | 3.6 g/l |

Table 2 gives cobalt content as g/l Co (B), bath pH and temperature and agitation and cobalt content of the deposit (measured in the regions shown in FIG. 1 as discussed below) and deposit thickness in the same location, in microns.

TABLE 2

| Ex. | B | pH | Temp. °C. | Agitation l/min air | % Co l.c.d. | % Co h.c.d. | Deposit thickness l.c.d. | Deposit thickness h.c.d. |
|---|---|---|---|---|---|---|---|---|
| 7 | 0.8 | 4.70 | 30 | 2 | 0.01 | 0.01 | 5.58 | 10.67 |
| 8 | 4.0 | 4.70 | 30 | 2 | 0.04 | 0.04 | 5.78 | 10.14 |
| 9 | 6.0 | 4.45–4.70 | 30 | 2 | 0.06 | 0.07 | 5.71 | 10.34 |
| 10 | 8.0 | 4.70 | 30 | 2 | 0.09 | 0.11 | 5.83 | 10.39 |
| 11 | 8.0 | 4.75 | 30 | 2 | 0.11 | 0.12 | 5.79 | 10.14 |
| 12 | 8.0 | 4.70 | 30 | 2 | 0.09 | 0.11 | 5.93 | 9.83 |
| 13 | 8.0 | 5.20 | 30 | 2 | 0.10 | 0.11 | 6.42 | 10.04 |
| 14 | 8.0 | 4.75 | 30 | (1) | 0.16 | 0.16 | 5.72 | 9.73 |
| 15 | 8.0 | 5.20 | 37 | 1.5 | 0.13 | 0.13 | 5.58 | 9.62 |
| 16 | 8.0 | 4.75 | 37 | 2 | 0.16 | 0.17 | 5.51 | 10.22 |
| 17 | 8.0 | 5.20 | 30 | none | 0.17 | 0.17 | 4.71 | 8.46 |
| 18 | 8.0 | 4.75 | 30 | none | 0.18 | 0.25 | | |
| 19 | 8.0 | 5.20 | 45 | 1.5 | 0.28 | 0.30 | 5.20 | 9.95 |
| 20 | 8.0 | 4.75 | 45 | 2 | 0.23 | 0.25 | 5.38 | 10.61 |
| 21 | 8.0 | 4.75 | 37 | none | 0.24 | 0.39 | 6.36 | 11.00 |
| 22 | 8.0 | 5.20 | 45 | none | 0.40 | 0.51 | 6.09 | 9.54 |
| 23 | 8.0 | 4.75 | 45 | none | 0.30 | 0.37 | 5.73 | 9.47 |

Note on Table 2
(1)cathode rod

FIG. 1 is a plan view of the Hull cell panels which were used for Examples 7 to 23 (and 24 and 25 below).

The cobalt content was determined by cutting out the sample areas marked LCD and HCD which are each 1 cm×2 cm and dissolving the samples in dilute hydrochloric acid and analysing for cobalt and zinc by I.C.P.

EXAMPLES 24 AND 25

The procedure of Examples 7 to 23 was repeated using the following bath composition for Example 24:

| | | |
|---|---|---|
| Ingredient A | $ZnCl_2$ | 80 g/l |
| Ingredient B | $CoCl_2$ | 32.5 g/l |
| Ingredient C | NaCl | 165 g/l |
| Ingredient D | Boric acid | 30 g/l |
| Ingredient E | Sodium benzoate | 5 g/l |
| Ingredient F | Benzylidene acetone | 0.05 g/l |
| | Alkyl naphthalene sulphonate | 0.2 g/l |
| | Diethylene glycol monoethyl ether | 0.2 g/l |
| Ingredient H | 2, 3, 7, 9 tetramethyl 5 decyn 4, 7 diol ethoxylated 30:1 | 0.48 g/l |

The bath for Example 25 was the same as for Example 24 except for the addition of 1 ml/l of triethanolamine (Ingredient G).

Table 3 below gives the same data for these examples as Table 2 did for Examples 7 to 22.

TABLE 3

| | | | Temp. | Agitation | % Co | | Deposit thickness | |
|---|---|---|---|---|---|---|---|---|
| Ex. | B | pH | °C. | l/min air | l.c.d. | h.c.d. | l.c.d. | h.c.d. |
| 24 | 8.0 | 4.80 | 28 | (1) | 0.46 | 0.60 | 6.57 | 9.54 |
| 25 | 8.0 | 4.75 | 28 | (1) | 0.52 | 0.78 | 6.41 | 9.72 |

Note on Table 3
(1)mechanical stirrer.

The products of Examples 7 to 25 were then subjected to 5% neutral salt spray corrosion testing in accordance with the procedure of ASTM B117. The results are given in Table 4 below as % red rust for various periods of exposure. Table 4 also gives for comparison the results from a standard 100% zinc plated panel (Example 26) of the same order of deposit thickness (8 microns).

TABLE 4

| | | Exposure period in hours | | | | | | | |
|---|---|---|---|---|---|---|---|---|---|
| Ex. | % Co | 48 | 72 | 96 | 120 | 144 | 168 | 192 | 216 |
| 26 | zero | start of R.R. | 30 | 60 | 80 | 90 | 90 | — | — |
| 7 | 0.01–0.01 | — | 30 | 30 | 50 | 60 | 60 | — | — |
| 8 | 0.04–0.04 | — | 10 | 15 | 20 | 30 | 50 | — | — |
| 9 | 0.06–0.07 | — | 10 | 10 | 20 | 30 | 40 | — | — |
| 10 | 0.09–0.11 | — | 5 | 5 | 20 | 20 | 30 | — | — |
| 14 | 0.16–0.16 | — | 3 | 3 | 3 | 5 | 15 | 30 | 40 |
| 16 | 0.16–0.17 | — | 1 | 1 | 1 | 5 | 5 | 20 | 25 |
| 18 | 0.18–0.25 | — | 1 | 1 | 1 | 5 | 10 | 25 | 30 |
| 20 | 0.23–0.25 | — | 1 | 1 | 1 | 5 | 5 | 5 | 10 |
| 21 | 0.24–0.30 | — | 1 spot | 1 | 1 | 5 | 10 | 20 | 20 |
| 23 | 0.30–0.37 | — | — | — | — | 1 spot | 1 spot | 2 | 15 |
| 24 | 0.46–0.60 | — | — | — | — | — | — | 1 | 5 |
| 25 | 0.52–0.78 | — | — | — | — | — | — | — | 1 spot |

EXAMPLES 27 TO 39

These examples show use of the process in a barrel plating procedure.

A barrel load was 150 steel nuts for which the average surface area per load was 10 square decimeters.

The plating sequence was as follows:

Conventional alkaline electrocleaner treatment
Cold water rinse
Conventional acid activation
Cold water rinse
Zinc cobalt plating using bath of Example 3
Cold water rinse
Pre-passivation acid dip, 10 seconds in 0.5–1% v/v aqueous nitric acid
Cold water rinse
Conventional yellow dichromate passivation using the bath described in Example 4 at room temperature with no air agitation, an immersion time of 40 seconds and a transfer time of 15 seconds
Cold water rinse
Drying The bath volume was 30 liters, the bath was filtered, the anodes were bagged zinc, the plating conditions were a temperature of 30° C., pH 4.4–5.0, the barrel was rotated conventionally e.g. at 10–30 RPM to produce mechanical agitation, current 5–10 Amps and plating time 20–40 minutes for Examples 27 to 34 and a temperature of 37° C., pH 4.4–5.10, same barrel agitation, current 5–10 Amps and plating time 20–40 minutes for Examples 35 to 37.

Table 5 gives details of pH, plating current (Amps), barrel agitation (volts), plating time (minutes), average deposit thickness (microns) and % wt of cobalt in the deposit being an average of the values for a number of nuts, and comments on the appearance of the deposit at the end of the sequence.

The cobalt value is an average value obtained by dissolving the plating in dilute hydrochloric acid and analysing for cobalt by I.C.P. analysis.

TABLE 5

| Ex. | pH | Current | Barrel agitation | Plating time | Thickness | % Co | Appearance |
|---|---|---|---|---|---|---|---|
| 27 | 4.75 | 10 | 10 | 20 | 4.0 | 0.23 | Bright yellow some bluish flecks. |
| 28 | 5.00 | 10 (4.2v)(1) | 10 | 20 | 4.7 | 0.29 | (2)(6) |
| 29 | 5.00 | 10 | 10 | 20 | 4.0 | 0.45 | (3) |
| 30 | 5.00 | 10 | 15 | 20 | 4.3 | 0.30 | Bright yellow with a few little dark blue spots. |
| 31 | 4.75 | 5 | 10 | 30 | 2.7 | 0.22 | (2) |
| 32 | 5.00 | 5 | 15 | 40 | 4.6 | 0.23 | (2) |

TABLE 5-continued

| Ex. | pH | Current | Barrel agitation | Plating time | Thickness | % Co | Appearance |
|---|---|---|---|---|---|---|---|
| | | (2.2v)[4] | | | | | |
| 33 | 4.40 | 10 | 10 | 20 | 4.5 | 0.26 | [2] |
| 34 | 4.50 | 10 | 15 | 20 | 4.2 | 0.28 | [3] |
| 35 | 4.50 | 5 | 15 | 40 | 5.1 | 0.24 | Semi-bright uniform. Very dull in recess. |
| 36[5] | 5.10 | 5 | 15 | 40 | 4.5 | 0.34 | Bright uniform. Dark coloured recess. |
| 37 | 4.40 | 10 | 15 | 20 | 4.9 | 0.43 | [3] |

Notes on Table 5
[1]This is the voltage measured at 10 Amps.
[2]Bright yellow - uniform.
[3]Bright with dark blue areas.
[4]This is the voltage measured at 5 Amps.
[5]Example 36 is the same as Example 35 except for the pH and the addition of 0.01 g/l of benzylidene acetone.
[6]When Example 28 was rerun the acid predip was omitted and the deposit was bright yellow and generally uniform but dark blue black stains were encountered in the yellow passivation.

It can be observed from Table 5 that at plating currents of 0.5 A/dm$^2$, at 30° C. and at pH 4.4–5.0 consistent bright platings were obtained with only some dulling effects in the l.c.d. area. Cobalt contents were in the range 0.22 to 0.25% and no passivation problems were encountered.

Cobalt contents in excess of 0.3% (Examples 35–37) can be achieved by increasing the temperature, raising the current density or decreasing the agitation. This resulted in dark blue spotting of the yellow passivate initially followed by heavy dark blue staining at cobalt contents above 0.4%.

Examples 32 and 37 were repeated, using conventional blue dichromate passivation, as Examples 38 and 39.

Corrosion resistance of these Examples 38 and 39 is reported in Table 6 below.

The blue passivate was found to emphasize any defects in the zinc cobalt electroplate whereas the yellow passivate diminished any defects and had a masking effect.

Neutral salt spray testing as in Examples 7 to 25 was then carried out and the results are given in Table 6 below qualitatively for the materials passivated with the blue passivate, and in Table 7 below quantitatively in terms of % area showing black or white rust after a given exposure period for the materials passivated with the yellow dichromate passivate.

TABLE 6

| Ex. | % Co | Passivate | Exposure period in hours 72 | 120 |
|---|---|---|---|---|
| 38 | 0.23 | blue | heavy white rust | 20% red rust |
| 39 | 0.43 | blue | heavy black and white rust | 50% red rust |
| 38 | — | blue | heavy white rust and start of red rust | 100% red rust |

TABLE 7

| Ex. | % Co | Passivate | Exposure period in hours 72[1] | 120[2] | 168[2] | 240[2] |
|---|---|---|---|---|---|---|
| 30 | 0.30 | yellow | 2 | 3 | 5 | 40 |
| 32 | 0.23 | " | 1 | 1 | 3 | 25 |
| 34 | 0.28 | " | 3 | 5 | 7.5 | 50 + RR[3] |
| 35 | 0.24 | " | 1 | 1 | 5 | 40 |
| 36 | 0.34 | " | 5 | 40 | 50 | 100 + RR[3] |
| 37 | 0.43 | " | 4 | 7.5 | 10 | 60 + RR[3] |

Notes on Table 7
[1]After 72 hours of neutral salt spray all samples showed the beginnings of black and white corrosion products. This column is a rating of the samples, 1 being least corrosion, 5 most corrosion.
[2]This is the % area of the sample covered with black or white corrosion.
[3]This indicates that red rust had started by the time 240 hours was reached.

EXAMPLE 40

Preparation of a zinc cobalt electrodeposit

A bath having the following composition was made up:

| | |
|---|---|
| Ingredient A | |
| Zinc chloride ($ZnCl_2$) | 78 g/l |
| Ingredient B | |
| Cobalt chloride ($CoCl_2.6H_2O$) | 33 g/l |
| Ingredient C | |
| Sodium Chloride | 170 g/l |
| | 103.2 g/l chloride ion |
| Total chloride ion | 153.7 g/l |
| Ingredient D | |
| Boric acid | 30 g/l |
| Ingredient E | |
| Sodium benzoate | 4.0 g/l |
| Ingredient F | |
| Benzylidene acetone | 25 mg/l |
| Ingredient G | Absent |
| Ingredient H | |
| 2, 3, 7, 9, tetramethyl 5 Decyn 4, 7 diol ethoxylated EO 30:1 | 2.0 g/l |
| Polyethylene glycol M.W. 1500 | 5 g/l |
| pH | 5.0 |

A flat mild steel panel was cleaned and activated conventionally using normal procedures for zinc plating steel and then given a 10 micron coating in the above bath at 50° C. for 10 minutes at a current density of 2 ASD using mechanical agitation. The deposit was bright, contained about 1.5 percent cobalt and had excellent corrosion resistance when tested by the neutral salt spray method of ASTM 117. While alloy deposits containing more than about 1% by weight cobalt can be employed, such higher alloy deposits are undersirable from an economic standpoint and have also been found to be less receptive, in some instances, to certain passivating bath compositions.

EXAMPLE 41

Preparation of a zinc cobalt electrodeposit

A bath having the following composition was made up.

| | |
|---|---|
| Ingredient A | |
| Zinc chloride ($ZnCl_2$) | 80 g/l |
| | 38.3 g/l zinc |
| Ingredient B | |
| Cobalt sulphate ($CoSo_4.7H_2O$) | 38.4 g/l |
| | 8 g/l cobalt |
| Ingredient C | |

-continued

| | |
|---|---|
| Sodium chloride (NaCl) | 165 g/l<br>100 g/l chloride ion |
| Total chloride ion | 142 g/l |
| Ingredient D | |
| Boric acid | 30 g/l |
| Ingredient E | |
| Sodium benzoate | 4.75 g/l |
| Ingredient F | |
| Benzylidene acetone ($C_6H_5CH{=}CHC{=}OCH_3$) | 0.1 mg/l |
| Ingredient G | |
| Triethanolamine | 1 ml/l |
| Ingredient H | |
| 2, 3, 7, 9, tetramethyl 5 decynol 4, 7 diol ethoxylated EO 30:1 | 4.8 g/l |
| pH | 4.5 |

A flat mild steel panel was cleaned and activated conventionally using normal procedures for zinc plating steel and then given a 10 micron coating by immersion in the above bath at 23° C. for 10 minutes at a current density of 2 ASD using mechanical agitation. The deposit was bright and contained 0.6 to 0.8% cobalt and had excellent corrosion resistance when tested by the neutral salt spray method of ASTM 117.

EXAMPLE 42

Production of a zinc flash

A bath was made up containing 80 g/l zinc chloride ($ZnCl_2$), 165 g/l sodium chloride, and 30 g/l boric acid with a pH of 4.5. The product of Example 41 was given a cold water rinse and then immersed in this bath as the cathode for 30 seconds to deposit a zinc flash about 0.1 to 0.5 microns thick, using the same plating conditions as in Example 41.

The electroplate was still bright in appearance.

EXAMPLE 43

Passivation of the zinc flash

A conventional yellow dichromate passivation bath was used.

The product of Example 42 was given a cold water rinse and immersed in the passivation bath at 22° C. for 20 to 30 seconds to passivate the zinc flash without completely dissolving it.

The passivated electroplate, after rinsing in cold water and then hot water and drying, still had a good, bright appearance.

What is claimed is:

1. An aqueous acidic electroplating bath for producing zinc-cobalt electrodeposits which comprises: as Ingredient A, zinc ions; as ingredient B, cobalt ions; as ingredient C, chloride ions; as ingredient E, benzoic acid, salicylic acid or nicotinic acid and the bath compatible alkali metal and ammonium salts thereof; as ingredient F, benzylidene acetone; as ingredient G, a compound selected from the group consisting of N-allyl thiourea and a compound having the formula:

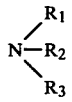

wherein:

$R^1$ represents an alkyl group having 1 to Y carbon atoms or an alkyl group having from 1 to Y carbon atoms at least one of which is substituted by a hydroxyl group; and $R^2$ and $R^3$ or both represent a hydrogen atom or an alkyl group of 1 to Y carbon atoms or an alkyl group of 1 to Y carbon atoms at least one of which is substituted by a hydroxyl group or an amino group and $R^2$ and $R^3$ may be the same or different and may be the same as or different to $R^1$, Y being an integer from 2 to 6; and as ingredient H, an ethoxylated long chain acetylenic alcohol; an ethoxylated alkylamine; a polyether having a molecular weight ranging from about 100 to about 1,000,000; a polyalkylene glycol; a polyglycidol; an ethoxylated phenol; an ethoxylated naphthol; an ethoxylated olefin glycol; an ethoxylated acetylenic glycol and mixtures thereof; the bath containing ingredients A, B, and C and at least one of ingredients E, F, G and H.

2. The bath as defined in claim 1 further including as ingredient D, a buffering agent.

3. The bath as defined in claim 2 in which ingredient D is boric acid and the bath soluble and compatible salts thereof present in an amount of about 15 to about 45 g/l.

4. The bath as defined in claim 1 containing at least two of ingredients E, F, G, and H.

5. The bath as defined in claim 1 containing at least three of ingredients E, F, G, and H.

6. The bath as defined in claim 1 containing ingredients E, F, G, and H.

7. The bath as defined in claim 1 having a pH of about 3 to about 6.

8. The bath as defined in claim 1 in which ingredient A is present in an amount of about 40 to about 120 g/l calculated as zinc chloride.

9. The bath as defined in claim 1 in which ingredient B is present in an amount of about 20 to about 60 g/l calculated as cobalt sulphate or cobalt chloride.

10. The bath as defined in claim 1 in which ingredient C is provided by alkali metal and ammonium chloride salts present in an amount of about 85 to about 245 g/l.

11. The bath as defined in claim 1 in which ingredient E is present in an amount of about 2 to about 12 g/l.

12. The bath as defined in claim 1 in which ingredient F is present in an amount of about 0.05 to about 0.5 g/l.

13. The bath as defined in claim 1 in which ingredient G comprises N-alkyl thiourea and is present in an amount of about 0.01 to about 1 g/l.

14. The bath as defined in claim 1 in which ingredient G comprises triethanolamine present in an amount of about 0.5 to about 5 ml/l.

15. The bath as defined in claim 1 in which ingredient H comprises said ethoxylated long chain acetylenic alcohol present in an amount of about 1 to about 10 g/l.

16. The bath as defined in claim 1 in which ingredient H comprises said ethoxylated alkylamine present in an amount of about 0.1 to about 10 g/l.

17. A process for producing a semi-bright to bright zinc cobalt electrodeposit on a conductive substrate which comprises the steps of immersing a substrate in the bath as defined in claim 1, cathodically electrifying the substrate and passing current between an anode and the substrate for a period of time sufficient to deposit the desired thickness of a zinc cobalt electrodeposit thereon.

18. The process as defined in claim 17 including the further step of controlling the pH of the bath within a range of about 3 to about 6.

19. The process as defined in claim 17 including the further step of controlling the temperature of the bath within a range of about 15° to about 30° C.

20. The process as defined in claim 17 in which the conductive substrate is non-planar.

21. The process as defined in claim 17 including the further steps of extracting the substrate having the zinc cobalt electrodeposit thereon from the bath, and thereafter applying a passivate coating on the zinc-cobalt electrodeposit.

22. The process as defined in claim 17 including the further steps of extracting the substrate having the zinc cobalt electrodeposit thereon from the bath, immersing the substrate in a second bath and electrodepositing a substantially pure zinc flash over the surface of the zinc cobalt electrodeposit.

23. The process as defined in claim 22 including the further step of controlling the thickness of the zinc flash electrodeposit which is sufficient to enable the zinc flash to be converted to an adherent substantially continuous zinc passivate.

24. The process as defined in claim 22 including the further steps of extracting the substrate with the zinc flash on the surfaces from the second bath and thereafter applying a passivate coating on the zinc flash.

* * * * *